US008925361B2

(12) United States Patent
Granny et al.

(10) Patent No.: US 8,925,361 B2
(45) Date of Patent: Jan. 6, 2015

(54) ANTI-THEFT DEVICE FOR AN ACCESS DOOR

(75) Inventors: Robert D. Granny, Rochester Hills, MI (US); David M. Trush, Troy, MI (US); John M. Dobish, Clinton Township, MI (US); Glenn L. Traister, Shelby Township, MI (US); Graham J. Spence, Troy, MI (US); Ian S. Buckley, Swartz Creek, MI (US); Grant W. Nelson, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 941 days.

(21) Appl. No.: 12/698,190

(22) Filed: Feb. 2, 2010

(65) Prior Publication Data

US 2011/0187156 A1 Aug. 4, 2011

(51) Int. Cl.

| | |
|---|---|
| ***E05B 5/00*** | (2006.01) |
| ***E05B 85/06*** | (2014.01) |
| ***E05B 17/20*** | (2006.01) |
| ***E05B 77/44*** | (2014.01) |
| ***E05B 79/12*** | (2014.01) |

(52) U.S. Cl.

CPC ..... *E05B 85/06* (2013.01); *E05B 17/2092* (2013.01); *E05B 77/44* (2013.01); *E05B 79/12* (2013.01)

USPC ..... 70/417; 70/208; 70/379 R; 70/451; 292/336.3

(58) Field of Classification Search

USPC ..... 70/208, 369, 370, 379 R, 380, 417, 451; 292/336.3

See application file for complete search history.

(56) References Cited

U.S. PATENT DOCUMENTS

| | | | | |
|---|---|---|---|---|
| 3,868,836 | A * | 3/1975 | La Roche | 70/240 |
| 5,046,340 | A * | 9/1991 | Weinerman et al. | 70/208 |
| 5,340,174 | A * | 8/1994 | Bender et al. | 292/336.3 |
| 6,240,754 | B1 * | 6/2001 | Petersen | 70/417 |
| 6,415,636 | B1 * | 7/2002 | Fukumoto et al. | 70/208 |
| 6,523,869 | B1 * | 2/2003 | Jensen et al. | 292/336.3 |
| 6,604,393 | B2 * | 8/2003 | Larsen et al. | 70/208 |
| 6,748,775 | B1 * | 6/2004 | Bucker et al. | 70/208 |
| 6,843,085 | B2 * | 1/2005 | Dimig | 70/237 |
| 6,952,940 | B2 * | 10/2005 | Molzer et al. | 70/210 |
| 6,976,375 | B2 * | 12/2005 | Minix | 70/208 |
| 7,237,411 | B2 * | 7/2007 | Pantke et al. | 70/208 |
| 7,603,881 | B2 * | 10/2009 | Yukihara et al. | 70/208 |

* cited by examiner

*Primary Examiner* — Christopher Boswell
(74) *Attorney, Agent, or Firm* — Quinn Law Group, PLLC

(57) ABSTRACT

A door having a latch mechanism is provided. The door also includes a bracket, and a pawl having a first aperture. The pawl is rotatably attached to the bracket and is operatively connected to the latch. The door additionally includes a key-cylinder adapted to selectively lock and unlock the latch by rotating the pawl, and a shield having a second aperture. Furthermore, the door includes a component connected to the key-cylinder. The component is aligned with and extends through the first and second apertures without contact with the pawl or with the shield, and is configured to not impede the rotation of the pawl by the key-cylinder when the component is aligned with the first and second apertures. The component is also configured to detach the pawl from the bracket and limit the key-cylinder extraction, when the key-cylinder is forcibly manipulated thereby causing the component to contact the shield.

18 Claims, 2 Drawing Sheets

FIG. 2
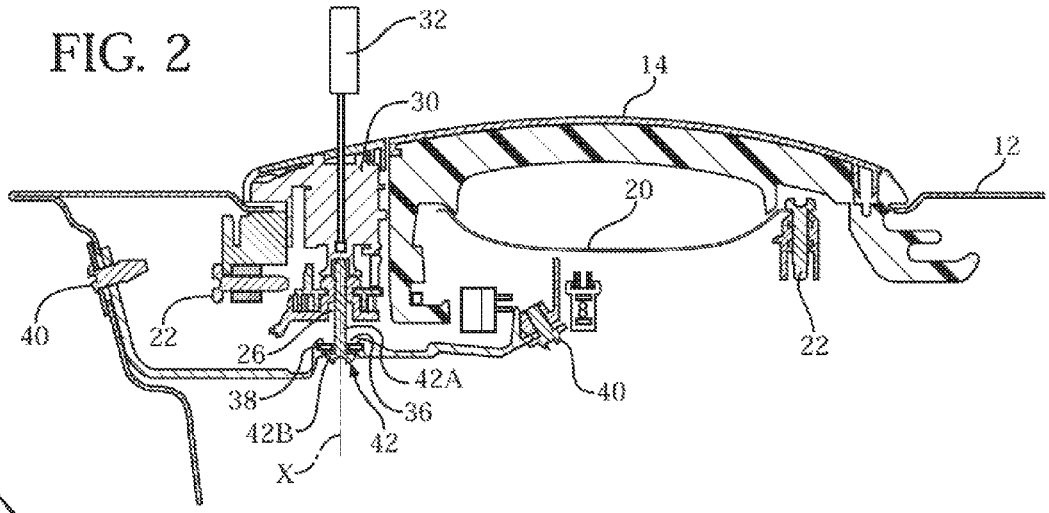
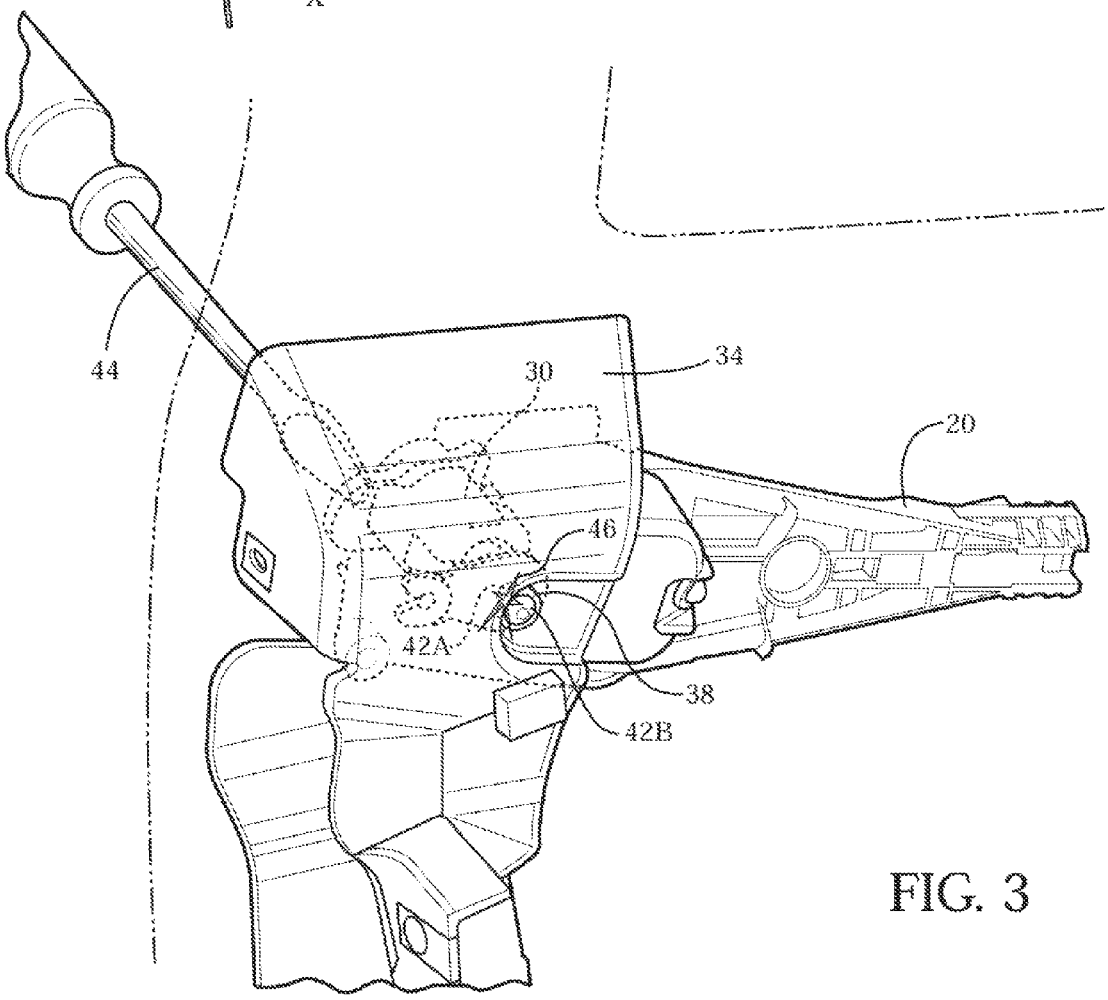
FIG. 3

ANTI-THEFT DEVICE FOR AN ACCESS DOOR

TECHNICAL FIELD

The invention relates to an anti-theft device for an access door.

BACKGROUND OF THE INVENTION

A typical vehicle has at least one access door. Such a door typically has a latch mechanism for maintaining the door in a locked state until access into or egress from the vehicle is required. The latch mechanism is typically actuated by an outside door handle to gain access to the interior of the vehicle.

Vehicles are sometimes subject to unauthorized entry and theft. To prevent such unauthorized entry while permitting authorized access, on at least some of the vehicle doors the latch mechanism is provided with an externally actuated lock having a key-lock cylinder. Attempts to gain unauthorized entry into the vehicle may include triggering the door latch mechanism by forcibly manipulating and even extracting the key-lock cylinder from the door.

SUMMARY OF THE INVENTION

A door is provided for an entryway. The door includes an exterior-facing surface and an inner structure. The door also includes a latch mechanism connected to the inner structure, configured to be fastened such that the door maintains closure of the entryway, and capable of being released, such that the door opens the entryway. The door additionally includes a bracket connected to the inner structure and a pawl having a first aperture. The pawl is rotatably attached to the bracket and is operatively connected to the latch mechanism. The door also includes a key-cylinder, i.e., a key-lock cylinder, accessible from the exterior-facing surface. The key-cylinder is adapted to selectively lock and unlock the latch mechanism by rotating the pawl. Additionally included is a shield having a second aperture. The shield is connected to the inner structure, such that the inner structure is disposed between the shield and the key-cylinder. Furthermore, the door includes a component connected to the key-cylinder and aligned with and extending through the first and second apertures without contact with the pawl or with the shield. The component is configured to not impede the rotation of the pawl by the key-cylinder when the component is aligned with the first and second apertures. The component is also configured to provide a detachment of the pawl from the bracket and limit an extraction of the key-cylinder, when the key-cylinder is forcibly manipulated thereby causing the component to contact the shield.

The component may be a metal fastener having a cap. In such a case, the fastener is threaded into the key-cylinder. The fastener cap may hook on to the shield and limit the extraction of the key-cylinder, when the key-cylinder is forcibly manipulated.

The shield may be formed from a plastic material. In such a case, the second aperture is defined by a metal washer connected to the shield.

The door may further include a rod, and, in such a case, the pawl may be connected to the latch mechanism via the rod. According to an embodiment, the detachment of the pawl from the bracket prevents unlocking of the latch mechanism.

The door may also include a door handle, wherein the door handle is attached to the bracket, and the key-cylinder is housed in, and protrudes through the door handle.

The above described door may be employed to facilitate ingress and egress in a vehicle.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 2 is a cut-away view of the assembled vehicle door having the anti-theft device shown in FIG. 1; and FIG. 3 is a close-up perspective view of the portion of the vehicle door shown in FIG. 1, illustrating a forcibly manipulated key-cylinder resulting in the anti-theft device limiting/preventing an extraction of the key-cylinder.

DESCRIPTION OF THE PREFERRED EMBODIMENTS

Figure 1:
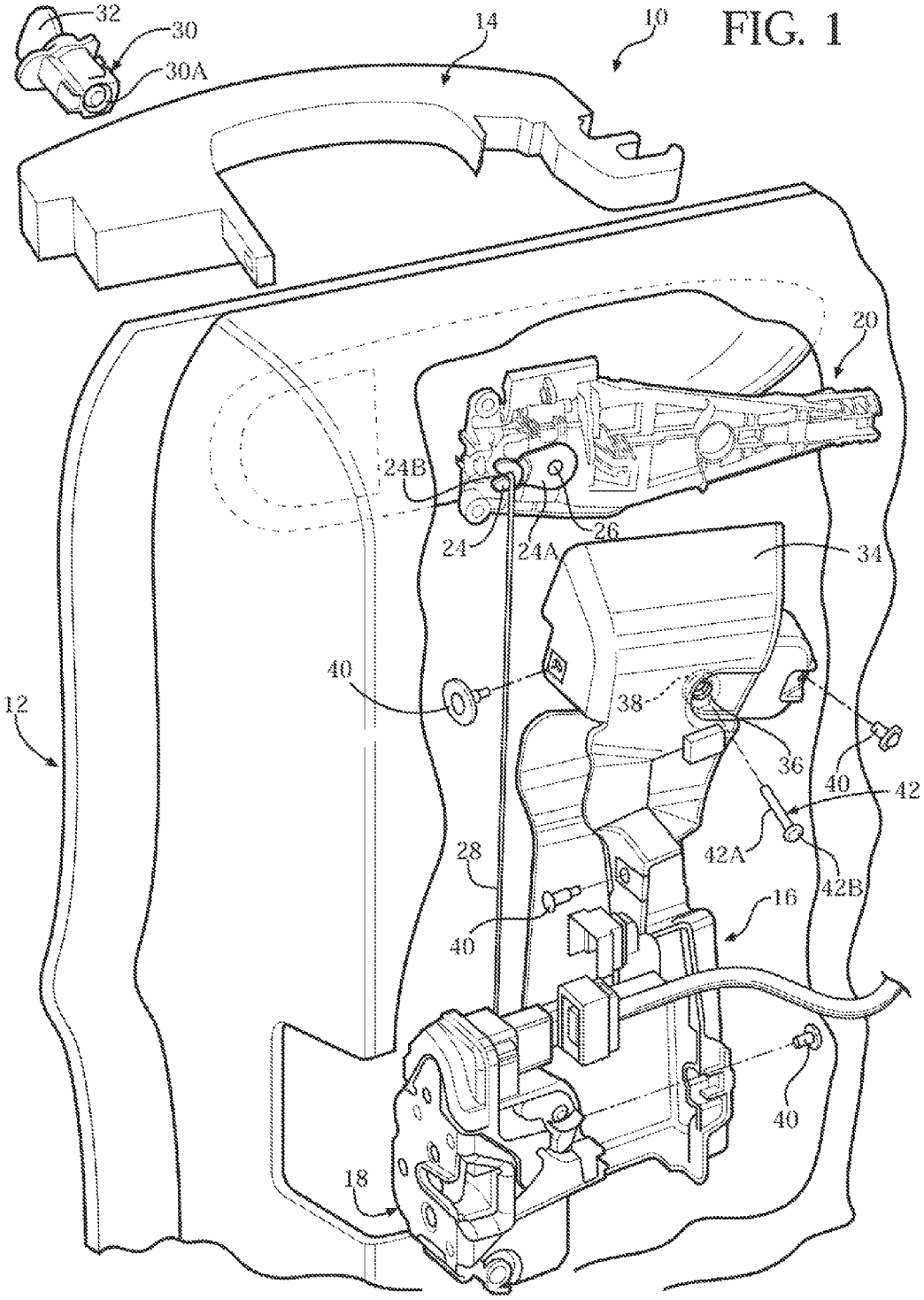
FIG. 1 is a perspective exploded view of a portion of a vehicle door illustrating an anti-theft device according to an embodiment.

Referring to the drawings, wherein like reference numbers refer to like components, FIGS. 1 and 2 show a vehicle door 10. The door 10 includes an exterior-facing surface 12. Exterior-facing surface 12 includes an exterior door-release handle 14. The door 10 also includes an inner structure 16. The inner structure 16 may have a unitary configuration, or a combination of interconnected brackets and/or mounting members that may be formed from any suitable materials such as steel or aluminum. Inner structure 16 is configured to support, among other items, exterior surface 12, a latch mechanism 18, and various wiring and other door hardware, such as for electrical locking, as known by those skilled in the art.

The latch mechanism 18 is configured to be released via exterior door-release handle 14, as well as via an interior door-release handle (not shown). Latch mechanism 18 is typically connected to the inner structure 16 via suitable fasteners, as known by those skilled in the art, and is configured to be fastened, such that door 10 maintains closure of an entryway into the vehicle, and is capable of being released by door-release handle 14 to permit the door to open the entryway. Also connected to the inner structure 16 is a bracket 20. Bracket 20 is configured to support door handle 14, and is attached to exterior surface 12 through the use of appropriate fasteners, such as screws 22 shown in FIG. 2.

A pawl 24 is rotatably attached to the bracket 20. Pawl 24 is manufactured from a suitable rigid material, such as steel, and includes a first aperture 26. Pawl 24 is operatively connected to latch mechanism 18 via a rod 28 for selectively locking and unlocking the latch. Pawl 24 is shown as having a largely rounded part 24A with an extended arm 24B, and the first aperture 26 is disposed substantially in the center of the rounded part of the pawl. The connection between pawl 24 and bracket 20 is such that the pawl is capable of rotating with respect to the bracket around an axis X which extends through the center of aperture 26. Rod 28 is disposed off axis X, such that when pawl 24 is turned or rotated the rod is translated with respect to latch 18 in order to selectively lock and unlock latch mechanism 18.

A key-cylinder 30, i.e., key-lock cylinder, is located on the door 10, such that the key-cylinder is accessible from the exterior-facing surface 12. Key-cylinder 30 includes a threaded aperture 30A, which is centered on and disposed along axis X. Key-cylinder 30 is adapted to selectively lock and unlock latch mechanism 18 by rotating pawl 24. Key-cylinder 30 is configured to be activated by an individual looking to gain access to the vehicle via a key 32 specifically adapted for the particular key-cylinder. Key-cylinder 30 is typically designed to be tamper-resistant, i.e., resistant to being jimmied open and turned to unlock latch 18 without the proper key 32.

A shield 34 is connected to inner structure 16, such that the inner structure is disposed between the shield and key-cylinder 30 (as shown in FIGS. 1 and 2). Shield 34 may be formed from a plastic or a metal material having suitable rigidity and toughness for resistance to penetration of the door structure through to the interior of the vehicle in case of forced manipulation and extraction of key-cylinder 30. Shield 34 includes a second aperture 36. When shield 34 is connected to inner structure 16, second aperture 36 is centered on axis X as permitted by the design and build tolerances of tooling used to form the shield. Second aperture 36 is shown as defined by a metal washer 38 that is rigidly connected to shield 34. Washer 38 may be either crimped over the shield 34 or be insert-molded with the shield, as understood by those skilled in the art. Shield 34 is connected to inner structure 16 by fasteners 40.

A component shown as a threaded bolt 42 (shown in FIGS. 1-3) is connected to key-cylinder 30 and is aligned with and extends through first and second apertures 26 and 36, respectively. In place of bolt 42 a different, specially formed, rigid component may also be employed, if such is necessitated by packaging or other concerns. Bolt 42 includes a body 42A and a cap 42B. Cap 42B has a diameter that is larger than the diameter of the second aperture 36. Body 42A is inserted into shield 34 through washer 38 in the direction of the pawl 24, through first aperture 26, and toward key-cylinder 32. Thus installed, by extending through both first and second apertures 26 and 36, bolt 42 does not physically contact either the pawl 24 or the shield 34. When body 42A reached key-cylinder 30, the bolt 42 is threaded into the threaded aperture 30A. Cap 42B is designed to not contact washer 38 during regular operation of key-cylinder 30. Bolt 42 is thus configured to rotate together with key-cylinder 30 when the key 32 is turned to lock or unlock the latch mechanism 18, without impeding regular action of the key-cylinder in any way.

Although bolt 42 does not restrict normal operation of key-cylinder 30, the bolt does operate to counteract forcible manipulation of the key-cylinder with the intent to gain unauthorized entry into the vehicle. In such a situation, it may be attempted to insert an implement, such as a screwdriver 44 (shown in FIG. 3), into key-cylinder 30 to exert a force and shift the entire key-cylinder in order to displace the rod 28 and unlock the latch mechanism 18. During such forcible manipulation, the entire exterior-facing surface 12 may be flexed in an attempt to trigger the latch mechanism 18. Upon such manipulation, however, bolt 42 will contact at least one of the washer 38 and pawl 24, thus restricting movement of key-cylinder 30 independent of exterior-facing surface 12, and reducing the likelihood of a successful forced triggering of latch mechanism 18. Contact 46 between washer 38 and body 42A and/or cap 42B of bolt 42 upon the above-described forcible manipulation is depicted in FIG. 3.

During the above-described attempts to gain unauthorized entry into the vehicle a sufficient amount of force may be applied, such that due to the resultant pressure applied via bolt 42, pawl 24 separates from bracket 20. In such a case, pawl 24 together with rod 28 will disengage from key-cylinder 30 and become inoperative. The result of such a consequence is that the latch mechanism 18 will remain locked, and unauthorized entry will be thwarted.

Most countries have specific national standards for vehicle anti-theft, which specify that the vehicle door must withstand forced manipulation as described above. Additionally, some of these standards specify a particular amount of time that a vehicle latch mechanism must withstand such forced manipulation. The construction of door 10 described above is intended to conform to such requirements.

While the best modes for carrying out the invention have been described in detail, those familiar with the art to which this invention relates will recognize various alternative designs and embodiments for practicing the invention within the scope of the appended claims.

The invention claimed is:

1. A door for closure of an entryway, the door comprising:
an exterior-facing surface;
an inner structure;
a latch mechanism connected to the inner structure, configured to be fastened, such that the door maintains closure of the entryway, and capable of being released, such that the door opens the entryway;
a bracket connected to the inner structure;
a pawl having a first aperture, the pawl rotatably attached to the bracket and operatively connected to the latch mechanism;
a key-cylinder accessible from the exterior-facing surface, the key-cylinder configured to selectively lock and unlock the latch mechanism by rotating the pawl;
a shield having a second aperture, and connected to the inner structure, such that the inner structure is disposed between the shield and the key-cylinder; and
a component having an integral cap positioned such that the shield is disposed between the cap and the inner structure, the component being connected to the key-cylinder and aligned with and extending through the first and second apertures without contact with the pawl or with the shield;
wherein the component is configured to not impede the rotation of the pawl by the key-cylinder when the component is aligned with the first and second apertures, and generates a detachment of the pawl from the bracket and limits, via contact between the component and the shield, an extraction of the key-cylinder from the door when the key-cylinder is forcibly manipulated.

2. The door of claim 1, wherein the component is a metal fastener threaded into the key-cylinder.

3. The door of claim 2, wherein the cap hooks on to the shield and limits the extraction of the key-cylinder when the key-cylinder is forcibly manipulated.

4. The door of claim 1, wherein the shield is formed from a plastic material.

5. The door of claim 4, wherein the second aperture is defined by a metal washer incorporated into the shield.

6. The door of claim 1, further comprising a rod, and the pawl is connected to the latch mechanism via the rod.

7. The door of claim 1, wherein the detachment of the pawl from the bracket prevents unlocking of the latch mechanism.

8. The door of claim 1, further comprising a door handle, wherein the door handle is attached to the bracket, and the key-cylinder is housed in the door handle.

9. The door of claim 1, wherein the key-cylinder is configured to be activated by a key.

10. A vehicle comprising:
an entryway;
a door for the entryway, the door having:

an exterior-facing surface;

an inner structure;

a latch mechanism connected to the inner structure, configured to be fastened, such that the door maintains closure of the entryway, and capable of being released, such that the door opens the entryway;

a bracket connected to the inner structure;

a pawl having a first aperture, the pawl rotatably attached to the bracket and operatively connected to the latch mechanism;

a key-cylinder accessible from the exterior-facing surface, the key-cylinder configured to selectively lock and unlock the latch mechanism by rotating the pawl;

a shield having a second aperture, and connected to the inner structure, such that the inner structure is disposed between the shield and the key-cylinder; and a component having an integral cap positioned such that the shield is disposed between the cap and the inner structure, the component being connected to the key-cylinder and aligned with and extending through the first and second apertures without contact with the pawl or with the shield;

wherein the component is configured to not impede the rotation of the pawl by the key-cylinder when the component is aligned with the first and second apertures, and generates a detachment of the pawl from the bracket and limits, via contact between the component and the shield, an extraction of the key-cylinder from the door when the key-cylinder is forcibly manipulated.

11. The vehicle of claim 10, wherein the component is a metal fastener threaded into the key-cylinder.

12. The vehicle of claim 11, wherein the cap hooks on to the shield and limits the extraction of the key-cylinder when the key-cylinder is forcibly manipulated.

13. The vehicle of claim 10, wherein the shield is formed from a plastic material.

14. The vehicle of claim 13, wherein the second aperture is defined by a metal washer incorporated into the shield.

15. The vehicle of claim 10, further comprising a rod, and the pawl is connected to the latch mechanism via the rod.

16. The vehicle of claim 10, wherein the detachment of the pawl from the bracket prevents unlocking of the latch mechanism.

17. The vehicle of claim 10, further comprising a door handle, wherein the door handle is attached to the bracket, and the key-cylinder is housed in the door handle.

18. The vehicle of claim 10, wherein the key-cylinder is configured to be activated by a key.

* * * * *